US006163977A

United States Patent [19]

Gaffar

[11] Patent Number: 6,163,977

[45] Date of Patent: Dec. 26, 2000

[54] ROOM AIR GEL DRYER

[75] Inventor: Shaik Abdul Gaffar, Northridge, Calif.

[73] Assignee: Shaik A. Gaffar, Northridge, Calif.

[21] Appl. No.: 09/084,772

[22] Filed: May 26, 1998

[51] Int. Cl.[7] ..... F26B 9/04

[52] U.S. Cl. ..... 34/143; 34/237; 34/239

[58] Field of Search ..... 34/302, 305, 143, 34/144, 237, 238, 239; 204/299 R, 182.8

[56] References Cited

U.S. PATENT DOCUMENTS 5,440,822 8/1995 Alpenfels et al. ..... 34/605

5,572,802 11/1996 Alphefels et al. ..... 34/192

*Primary Examiner*—Pamela Wilson

[57] ABSTRACT

Room Air Gel Dryer contains a system of hinges for movement and alignment of frames. It has another system of latches and thumb screws for tightly holding or releasing different frames. Both of the above described systems keep various separate components stay and work together as one unit. Wall plates not only hold this gel dryer horizontal but also make it stand with excellent stability. Special grooves present in the lateral sides assist in separating different frames and in the collection of dry acrylamide gel-cellophane sandwich.

13 Claims, 15 Drawing Sheets

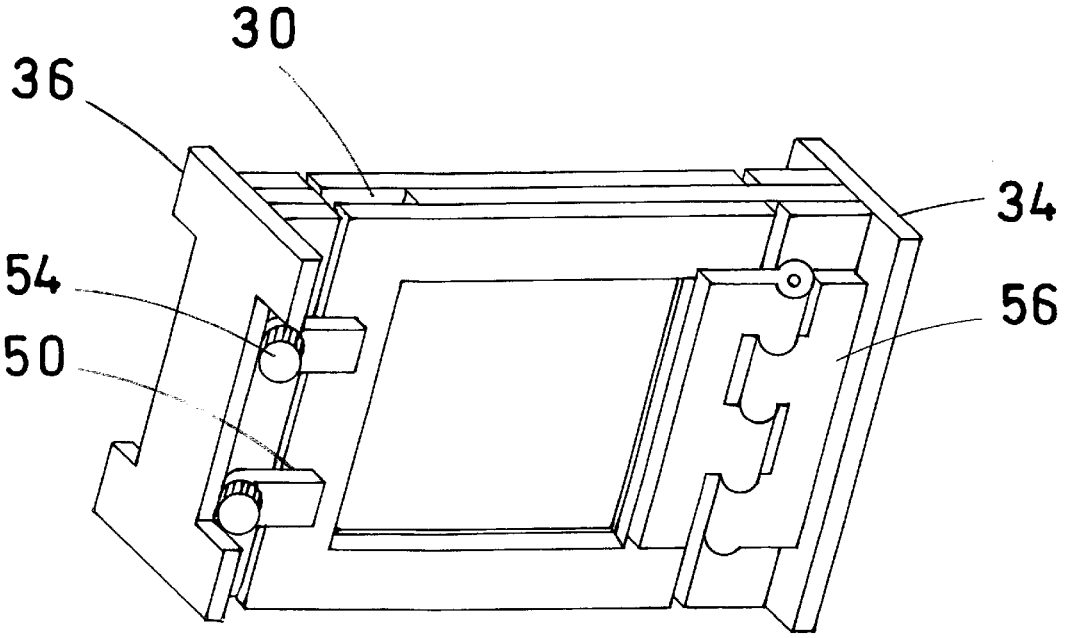
FIG. 7B
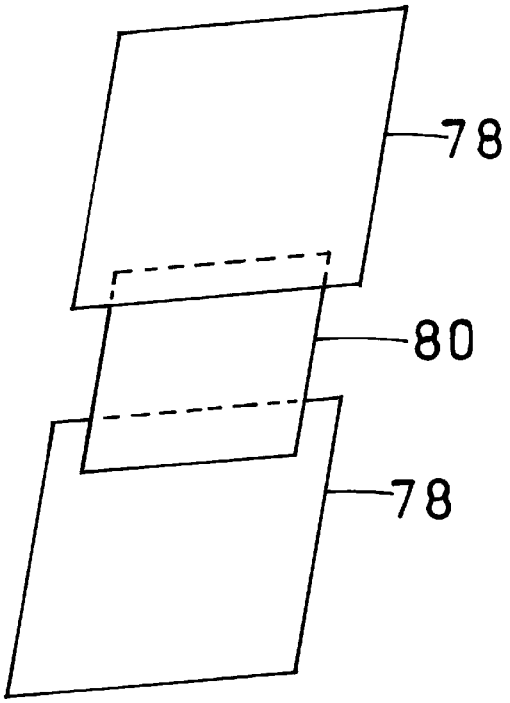
FIG. 7B1

ROOM AIR GEL DRYER

CROSS-REFERENCE TO RELATED APPLICATIONS

Not applicable

STATEMENT REGARDING FEDERALLY FUNDED RESEARCH OR DEVELOPMENT

Not applicable

REFERENCE TO MICROFICHE APPENDIX

Not applicable

BACKGROUND OF THE INVENTION

This invention specifically relates to electrophoresis used in biochemical and immunochemical experiments.

Electropheresis separates biological molecules in a mixture into individual components under the influence of electric current. In addition to others, it requires a porous physical support. At present, polymerized acrylamide is commonly used as an inert gel matrix because it offers many advantages. In several analytical as well a preparative studies, acrylamide based gel electrophoresis is used as a method of choice to separate proteins, nucleic acids and a carbohydrate complexes.

As a technique, gel electrophoresis has become very popular because, it requires only a small amount of sample for analysis, its parameters can be changed to suit different needs, and biologicals can be analyzed in native and denaturing conditions. After separation, molecules such as proteins can be fixed in gel and then stained with dye. After destaining, isolated proteins are seen as bands of color. The destained gels are then dried for handling easily, for analyzing molecular properties, and for storing.

Active and passive methods, based on dehydration, are used to preserve acrylamide gels containing stained proteins. In active methods, gel is usually dehydrated by using vacuum suction with or without applying heat. In one method, U.S. Pat. No. 4,883,597, gel placed on a polyethylene membrane is dried by applying vacuum. In another method, U.S. Pat. No. 4,020,563, acrylamide gel placed on a filter paper, is dehydrated by a combination of heat and vacuum suction. The end product is a filter paper containing a thin film of dry gel where protein pattern is seen only by reflected light. Generally, thick bands are seen clearly; but thin bands are seen with poor distinction. Other complex apparatus containing heating mechanisms are described in U.S. Pat. Nos. 4,612,710 and 4,778,778. These methods of drying are generally expensive because they require a) an apparatus to keep filter paper-gel complex air tight, b) a mechanism to heat the gel assembly, c) a pump to generate vacuum, and d) a trap for removing liquid vapors. Trap needs an effective cooling system to condense and then freeze all vapors before they pollute vacuum pump oil. Eventhough gels are dried fast, more than often, gels crack because of vacuum drawing fluid rapidly from the surface of gel.

In passive method, the amount of water is decreased by first soaking the gel in a solvent mixture such as ethyl alcohol, glycerol and water. After this treatment, the size of gel usually shrinks approximately by 10 to 15%. A passive method of drying a slab gel is described by Wallevik, K and Jensenius, J. C., in the *Journal of Biochemical and Biophysical Methods,* 6, (1982) 17–21. In their method, liquid is evaporated a room temperature, in open air, from both surfaces of slab gel. This is accomplished first by making cellophane-gel-cellophane sandwich and then placing it between two frames held together b metal binder clamps.

Cellophane provides transparency and also supports the gel for easy handling during drying. Also, cellophane b making acrylamide attach to its surface, minimizes the appearance of cracks in the gel. Basically, cellophane is nothing more than thin flat gel supports. These cellophanes sheets are commonly available from most stores which sell plastic hand bags, lunch bags and other types of think plastic sheets.

Other manufacturers have described apparatus containing variations for passive method of drying gels. The gel drying system of Hoeffer Scientific Instruments contains frames and a platform. The platform fits into the opening of the lower frame. This provides a stage for assembling gel-cellophane sandwich directly on the frame. The gel dryer of Kem-En-Tec has legs in the frame which support the unit stay horizontal above the flat surface of bench. The apparatus manufactured by Novel Experimental Technology U.S. Pat. Nos. 5,440,822 and 5,572,802, contains a base unit whose flat top fits into the opening of lower frame for assembling gel-cellophane sandwich. The trough of base collects any droops of liquid if oozes out during the assembly. Frames and gel sandwich complex is held together by plastic clips. The complete assembly stands erect on the legs present on one end of both frames.

Each of the gel drying apparatus of the prior art, along with other features, is aimed to enhance uniform drying of the gel which is flanked by cellophane sheets. However, the disadvantages are that each unit has several individual parts such as frames, plates, base, metal clamps or plastic clips which have to be assembled and disassembled after every use. Metal clamps rust because of contact with various reagents. Plastic clips are hard to push in to place because of increase thickness of the assembled product. At the end of drying, it is equally hard to remove tightly placed clips because of lack of proper grip. After drying, the surfaces of plate, frame and gel-cellophane sandwich stay tightly stuck to one another. To separate them, normally a sharp tool such as a knife, chisel or a razor blade is used to ply open. Repeated use of these sharp tools causes permanent damage to the surfaces of frames and often cuts the gel cellophane sandwich.

From the above described information, it is clear that there is a need for a gel dryer, which remains as one entity with no requirements for assembly and disassembly of separate parts either before or after use. Such a unit because of localization of various parts, eliminates orientation and alignment of frames which otherwise is needed for assembling gel-cellophane sandwich in the unit. It should incorporate other provisions such as a platform without requiring a separate stage, a mechanism to hold tightly the gel sandwich between frames without requiring plastic clips or metal clamps, a structural feature to separate frames as well as dry gel without needing an additional tool, and a system to make the unit stand on its components so that gel can dry either from one surface or from both surfaces. Such a unit is described in this invention. Any liquid that oozes out during the assembly can be removed easily by wiping the unit with a disposable paper towel.

OBJECTS AND ADVANTAGES

The objects and advantages of RoomAir Gel Dryer are:

1. To attach all parts functional entity that is simple to use.
2. To use hinges for moving and aligning frames used in the apparatus.

3. To provide grooves in the unit for separating frames with fingers.
4. To use wall plates for holding the unit erect for drying gel.
5. To provide latches and thumb screws for holding gel tightly by frames, and
6. To fabricate the apparatus from commonly available materials which are durable, hard and tough to break.

Further objects and advantages will be apparent from the following description and drawings.

BRIEF SUMMARY OF THE INVENTION

Several features of RoomAir Gel Dryer make drying acrylamide slab gel simple and convenient. Gel-cellophane sandwich is assembled on main frame while stage frame with attached plate supports from below. The gel-cellophane assembly is then retained in place securely by top frame. Stage frame is then disengaged to dry gel from both surfaces. Protein bands can be seen in gel whether the apparatus is in horizontal or vertical positions. The apparatus can be easily transported by hand, for instance, to areas of maximum air draft. Special grooves present in the lateral sides of main frame assist in separating frames and in collecting dried gel without any need for tools. All components stay with the apparatus. No parts rust with time. RoomAir Gel Dryer needs very little space to store, and very quick to set up.

BRIEF DESCRIPTION OF THE DRAWINGS

In the drawing, all closely related figures have same number but different alphabetic suffixes.

FIG. 7B shows Double Side One Gel Dryer kept erect on a lateral side.

FIG. 7B1 sows gel supports on both sides of a slab gel.

REFERENCE NUMERALS IN DRAWINGS

Figure 1:
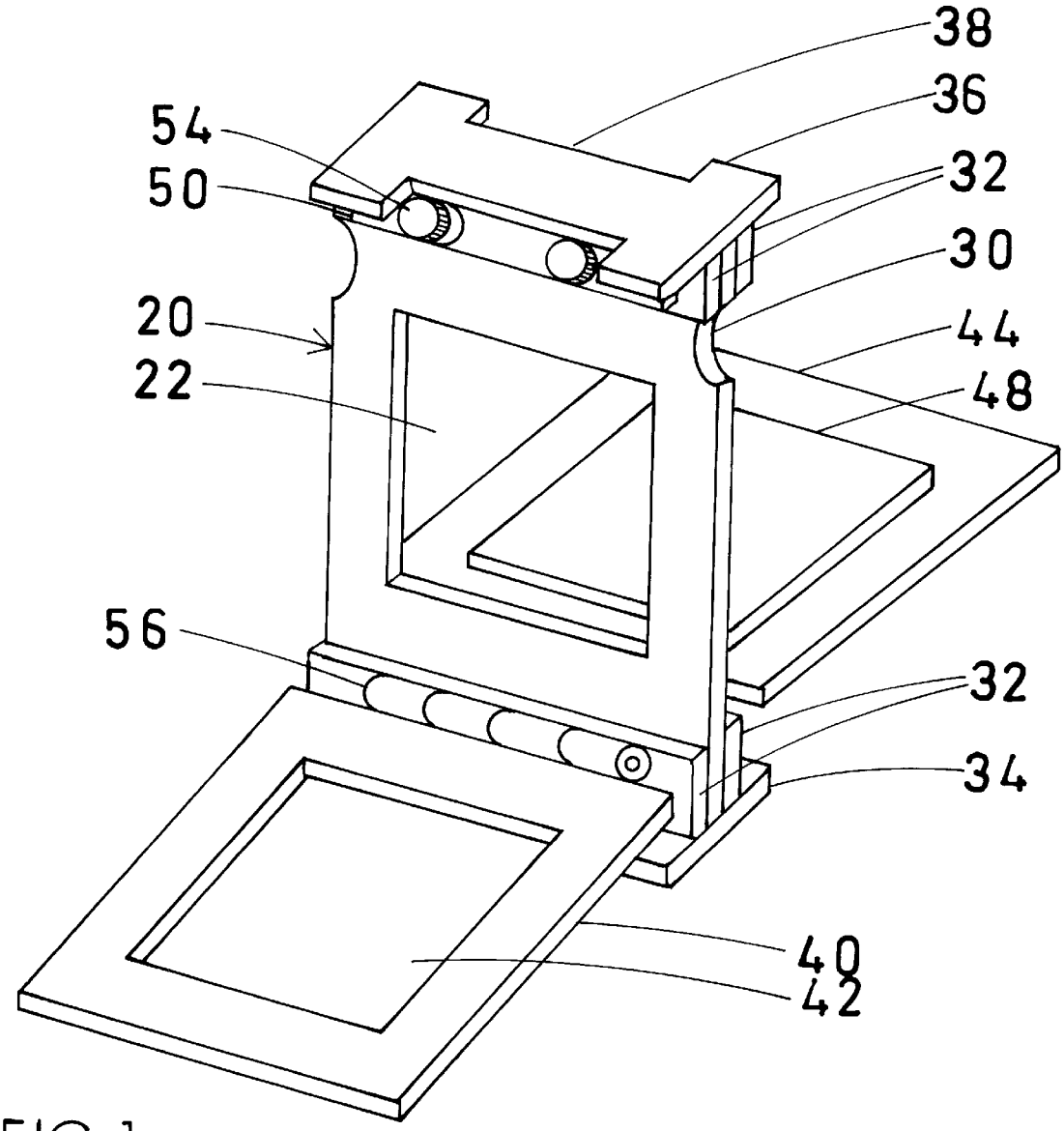
FIG. 1 shows a perspective view of Double Side One Gel Dryer with frames open.

20 main frame
22 square opening of main frame
24 lateral side of main frame
26 top end of main frame
28 bottom end of main frame
30 concave groove of main frame
32 anchor plate
34 wall plate
36 modified wall plate
38 deep groove of modified wall plate
40 top frame
42 square opening of top frame
44 stage frame
46 square opening of stage frame
48 stage plate
50 latch
52 hole of latch
54 thumb screw
56 hinge
58 hole for thumb screw
60 main plate
62 etched square outline for gel
64 mini gel frame
66 maxi gel frame
68 wide main frame
70 oblong hole
72 hole for nail
74 wide main plate
76 further modified wall plate
78 thin flat gel supports
80 acrylamide slab gel
82 flat surface of a table top
84 width of main frame
86 top surface of top anchor plate
88 width of wall plate
94 top flat surface of main frame
96 bottom flat surface of main frame
98 top flat surface of anchor plate
100 bottom flat surface of anchor plate
102 lateral side of anchor plate
103 top end of anchor plate
104 bottom end of anchor plate
106 flat surface of wall plate
108 lateral side of wall plate
110 top end of wall plate
112 bottom end of wall plate

DETAILED DESCRIPTION OF THE INVENTION

Unless mentioned otherwise, all plates, frames and latches described below are made from acrylic sheets having a thickness ranging from 0.2" to 0.5". The final apparatus is assembled, where necessary, by attaching various parts using solvent adhesive.

A perspective view of the first preferred embodiment of RoomAir Gel Dryer is shown in FIG. 1. It is a Double Side One Gel Dryer. The unit has a rectangular main frame 20 (FIGS. 1, 2D), made from a single piece of plate. The plate, with two flat surfaces, with a top end and a bottom end, has a length between 6" to 8" and a width between 5" to 7". A square opening 22 with sides ranging in length between 3" to 4" is cut in the middle of the plate. The resulting main frame has two lateral sides 24, each of same length and a top end 26 and a bottom end 28, each of same width 84. A shallow concave groove 30, approximately 0.75" long 0.25" to 0.5" deep, is cut in each lateral side towards the top end of the main frame.

Figures 2A, 2B, 2C, 2D:
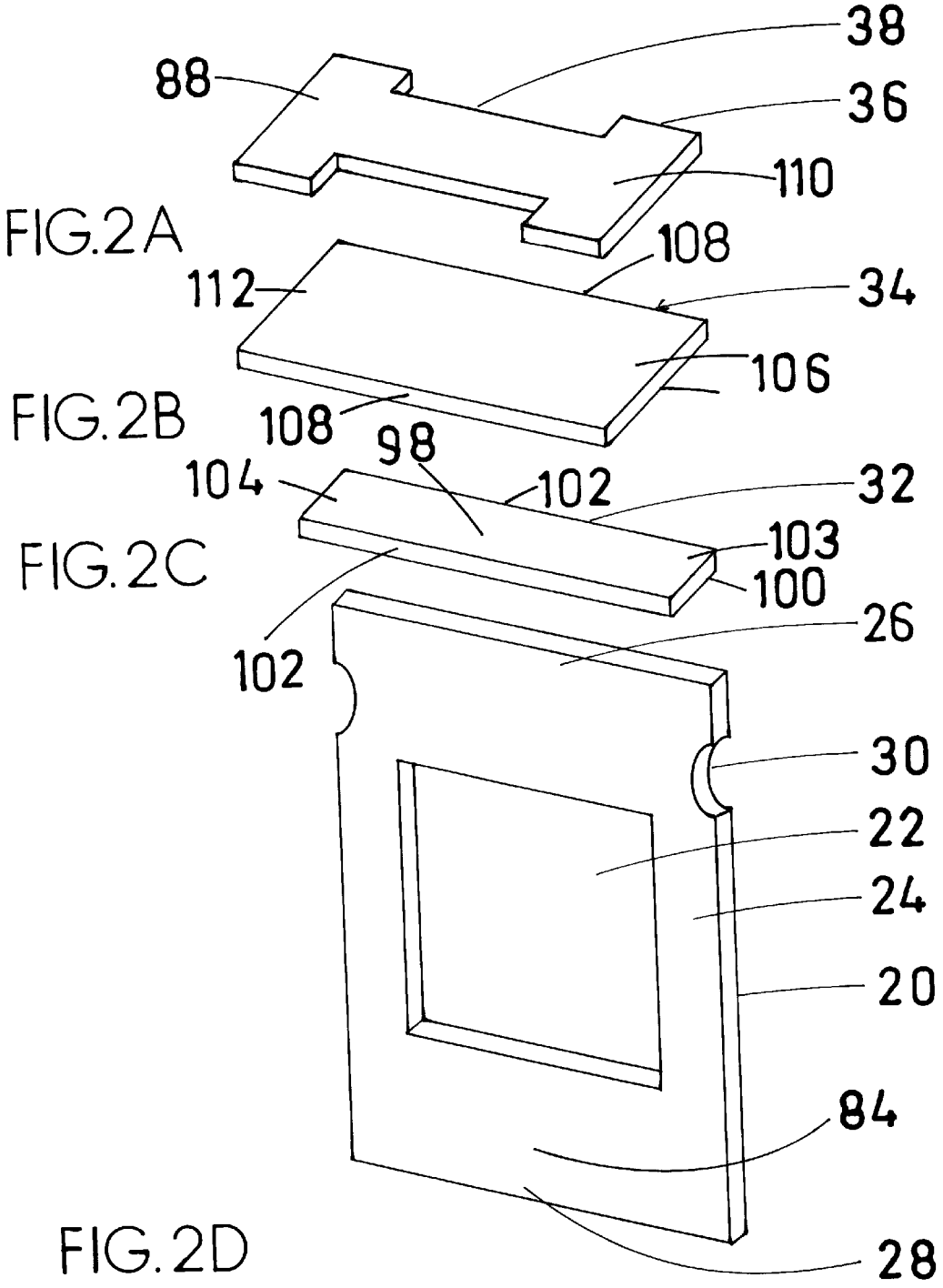
FIGS. 2A and 2B show wall plates, 2C shows anchor plate, and 2D shows main frame.

Each anchor plate 32, is rectangular with two flat surfaces, two lateral sides and a top end and a bottom end (FIG. 2C).

The approximate length of the two lateral sides as well as one flat surface 98 and another flat surface 100 of each anchor plate ranges from 5" and 7" and equals to the width of the main frame. Each anchor plate has two narrow ends each with a width ranging from 0.5" to 1".

Each wall plate is shaped like a rectangle. Each wall plate as two flat surfaces 106, two lateral sides 108 and a top end 110 and a bottom end 112. The length of each lateral side ranges from 5" to 7" and equals to the width of main frame. The width 88 of each end ranges from 1.5" to 2". Wall plate 34 at the bottom end of main frame is shown in FIG. 2B. Wall plate 36 that goes to the top end (FIG. 2A) of main frame is modified. Grooves 38 ranging in length between 4" to 6" are made in the two lateral sides.

Figure 5:
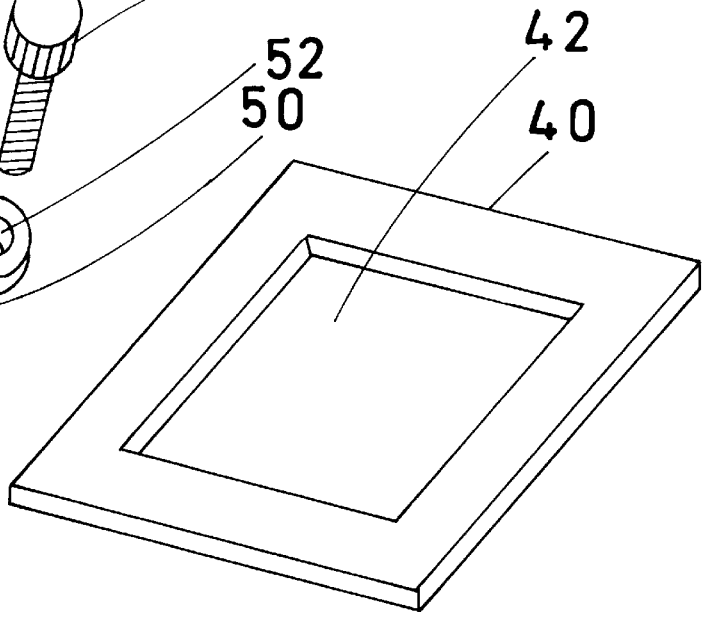
FIG. 5 shows top frame with opening.

Top frame 40, made from a single piece of plate with two flat surfaces, looks like a square (FIG. 5). The length of each side ranges from 5" to 7" and equals to the width of main frame. A square opening 42 having sides, each side ranging in length between 3" to 4", is made in the center of the plate to obtain the top frame. The square opening of top frame equals in dimensions with those of main frame.

Figure 3A:
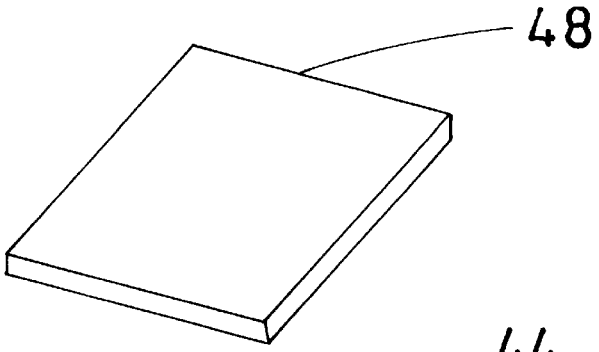
FIG. 3A shows stage plate and 3B shows stage frame.
Figure 3B:
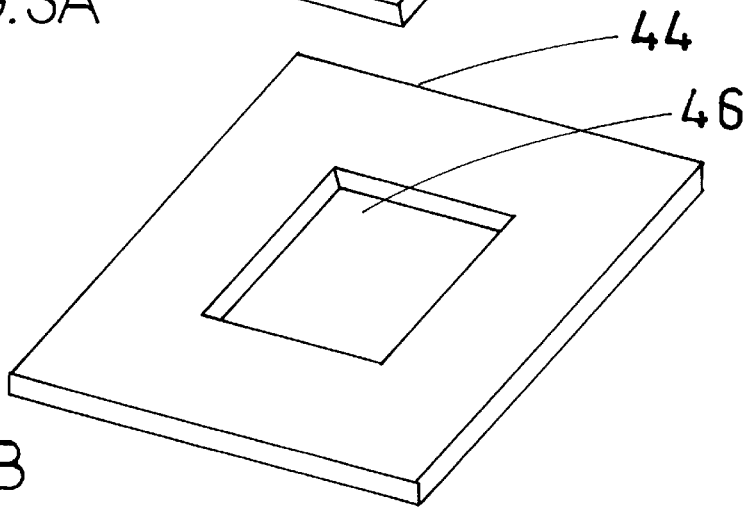

Stage fame 44, made from a single piece of plate, with two flat surfaces looks like a square (FIG. 3B). The length of each side ranges from b 5" to 7" and equals to the width of main frame. A square opening 46 having each side a length of 2.5" is cut in the center of the plate to derive stage frame. The outer dimensions of the stage frame are also equal to the outer dimensions of the top frame.

Stage plate 48 with two flat surfaces looks like a square (FIG. 3A). The length of each side ranges from 2.95" to 3.95". Stage plate easily overlaps all edges of the opening present in the center of the stage frame for attaching. Also, stage plate fits into the square opening of main frame with some gap on all four sides for easy sliding.

Figure 4A:
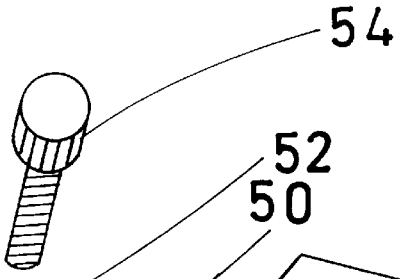
FIG. 4A shows thumb screw and 4B shows latch.
Figure 4B:
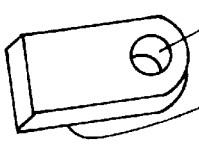

Each latch 50 is a small rectangular plate with two flat surfaces, two lateral sides and a top end and a bottom end (FIG. 4B). The length of each lateral side ranges from 0.75" to 1.5" and the width of either ends ranges from 0.5" to 1". A hole 52 of 0.3" diameter is made at one end. The end of latch having hole is shaped like a semicircle. A total of 3 latches are used per apparatus. Two latches secure top frame and one latch secures stage frame.

A nylon thumb screw 54 (FIG. 4A), ranging in length from 0.5" to 1", having a diameter 0.25", regulates each latch. One thumb screw is used per latch.

Each acrylic hinge 56 (FIG. 1) ranges in length between 1.75" and 2.5" and in width between 1.25" and 1.5". One hinge is used for attaching top frame and another for attaching stage frame.

ASSEMBLY

Figure 6:
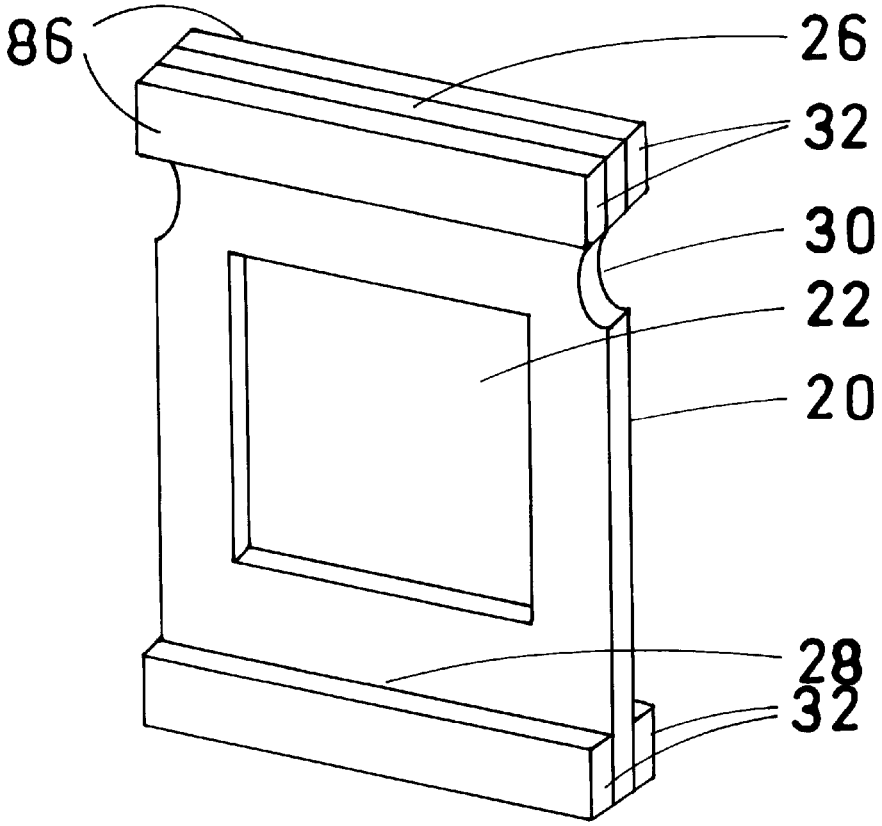
FIG. 6 shows main frame with attached anchor plates.
Figure 7:
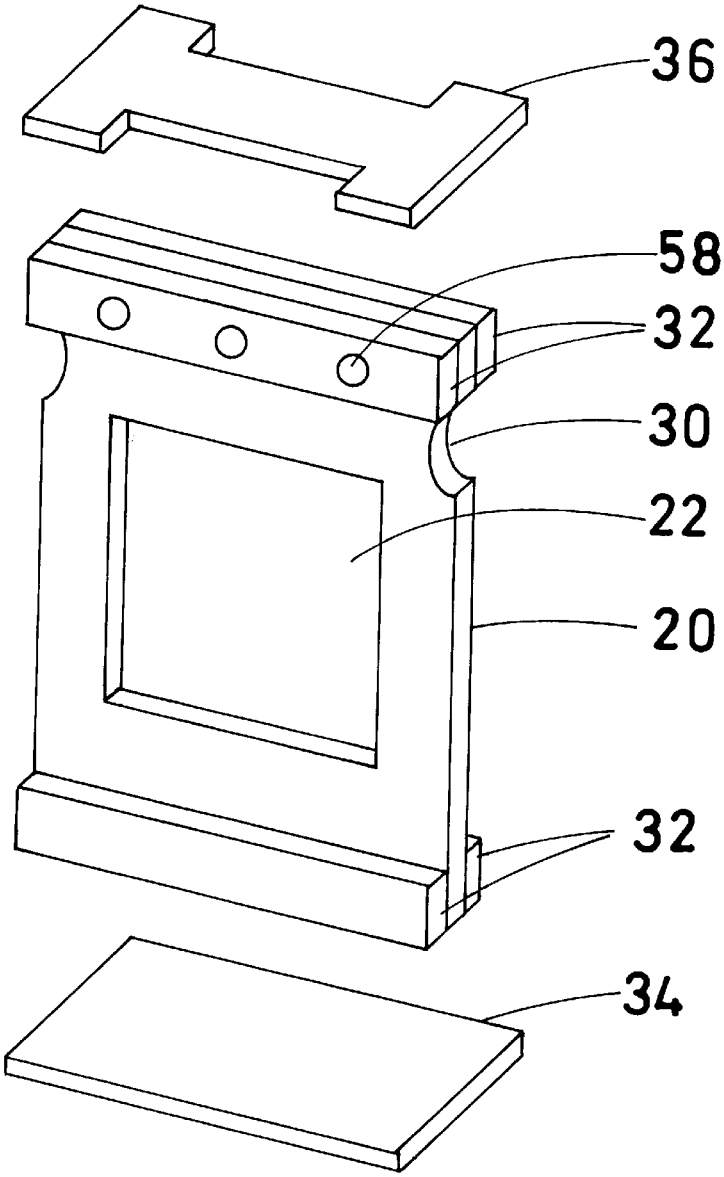
FIG. 7 shows holes for thumb screws and position of wall plates.

To one flat surface 94 (FIG. 1A), at the tope end 26 (FIG. 2D) of the main frame 20 (FIG. 2D), an anchor plate 32 is attached by one flat surface 98 (FIG. 2C) of its two flat surfaces. Prior to attaching by using solvent adhesive, one lateral side 102 (FIG. 2C) of the anchor plate is aligned with the edge of the top end 26 (FIG. 2D) of the main frame and the two edges of the top 103 (FIG. 2C) and bottom ends 104 (FIG. 2C) of the anchor plate are aligned with the two lateral sides 24 (FIG. 2D) of the main frame 20. This step is repeated to attach another anchor plate to the other flat surface 96 (FIG. 1B), at the tope end of the main frame. These above described two procedures are repeated at the bottom end 28 (FIG. 2D) of the main frame for attaching two more anchor plates. The main frame, in total has 4 anchor plates, 2 located at the tope end, and 2 located at the bottom end (FIG. 6). Each flat surface of the main frame, thus has two anchor plates with edges of both, the main frame and the anchor plates, aligned (FIG. 6). At the tope end of main frame three holes 58 are made by using a 0.2" drill bit (FIG. 7). Each hole cuts through the thickness of the plates assembly. By using a tap, screw thread (16/inch) is cut in each hole for placing a thumb screw. Two holes are located approximately 1" away from the two lateral sides of the main frame while the third hole is locates in the middle, approximately at an equal distance from the other two holes.

Figure 7A:
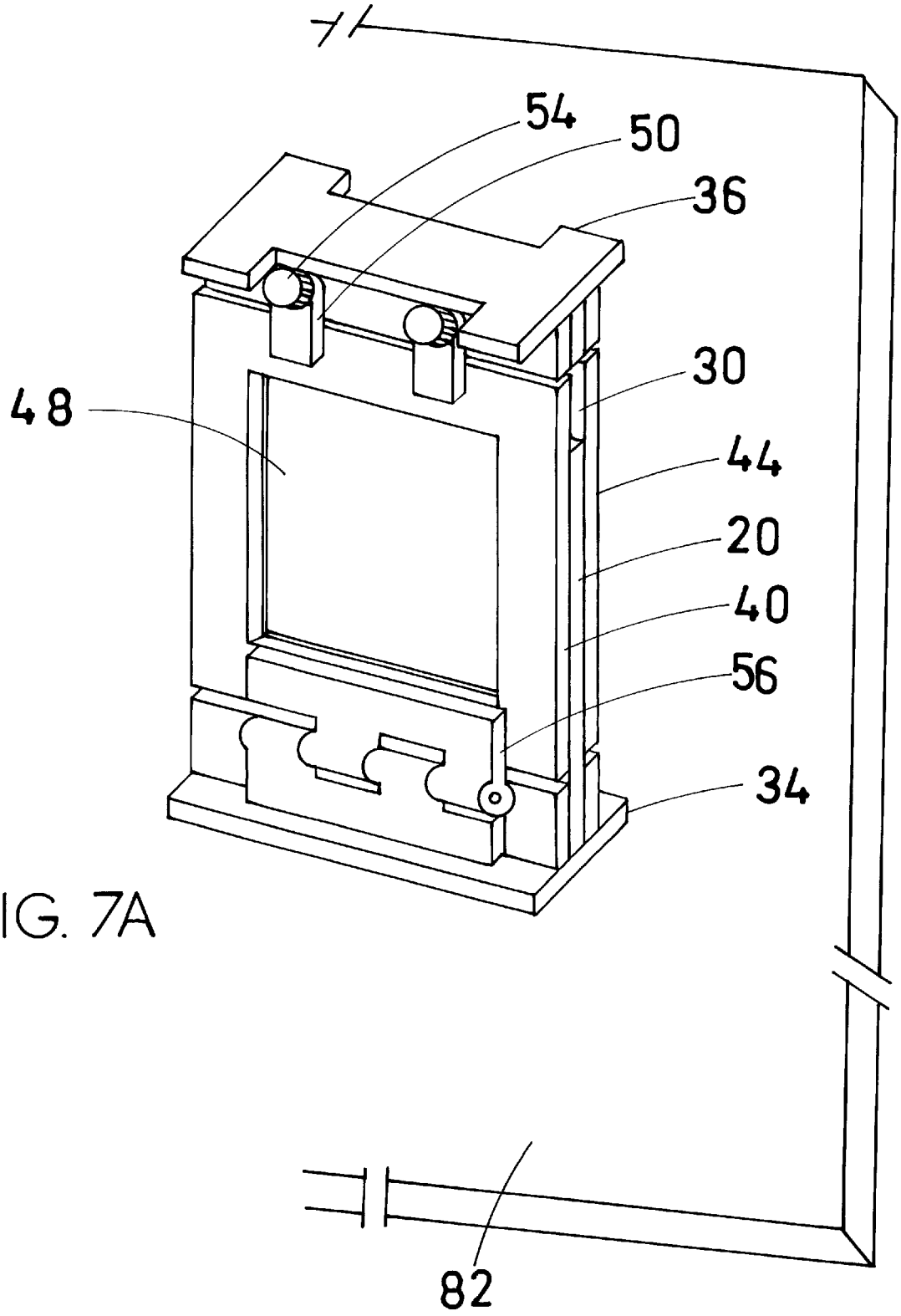
FIG. 7A shows attached hinge and engaged latches of Double Side One Gel Dryer.

Next, one wall plate 34 (FIG. 7) is attached to the bottom end 28 of main frame (FIG. 7). The edge of the bottom end of the main frame is made to stand erect in the middle of the wall plate with the lateral sides of the main frame aligned with the edges of the top 110 (FIG. 7) and bottom 112 ends of the wall plate. The wall plate is then adjusted so that its width is equally distributed from the main frame (FIG. 7A). When attached by using solvent adhesive, the flat surface of wall plate remains perpendicular to the flat surfaces of the main fame. This step is essentially repeated at the top end 26 of the main frame by using a modified wall plate 36 (FIGS. 7, 7A).

Figure 1A:
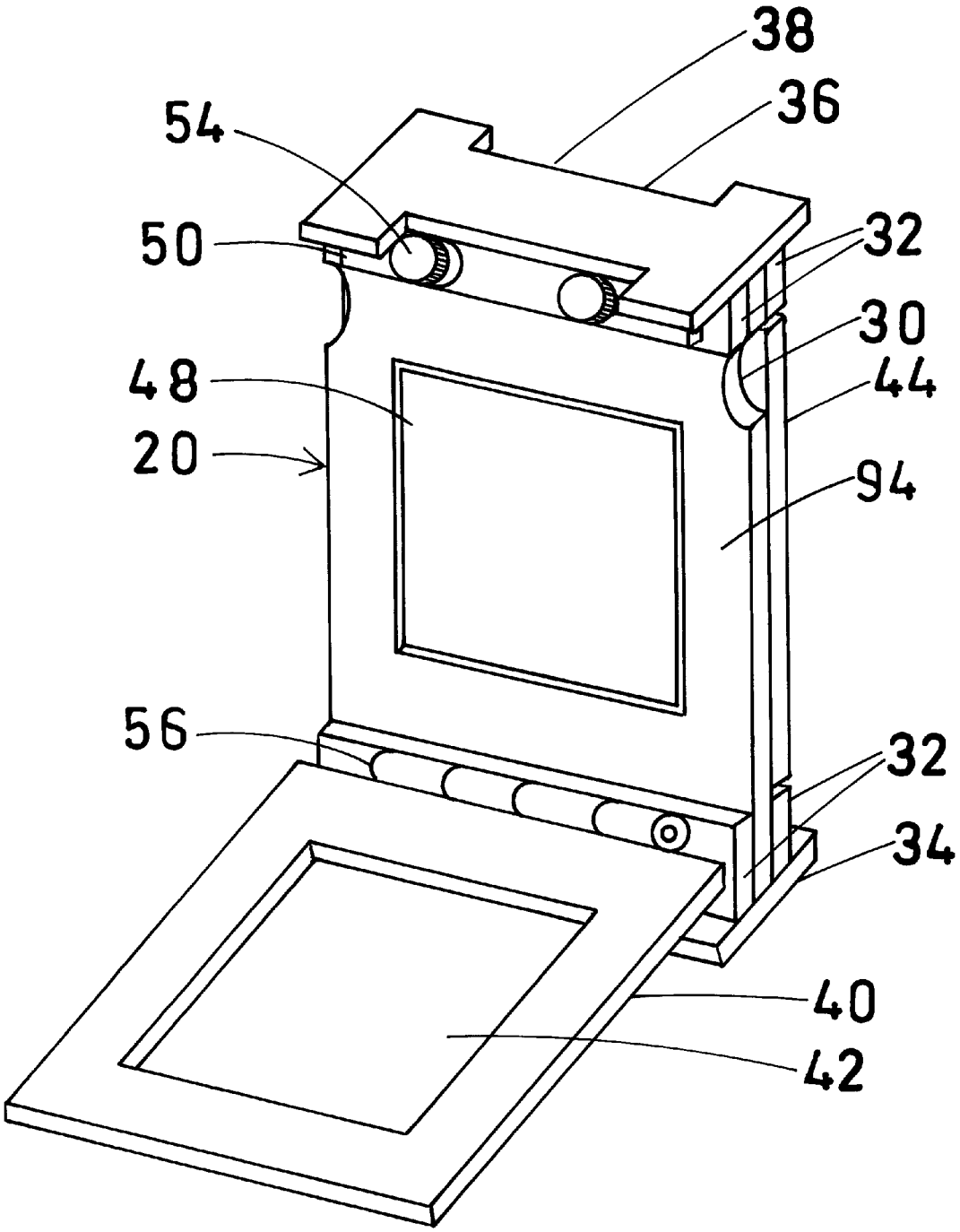
FIG. 1A shows Double Side One Gel Dryer with stage frame closed, top frame open.
Figure 1B:
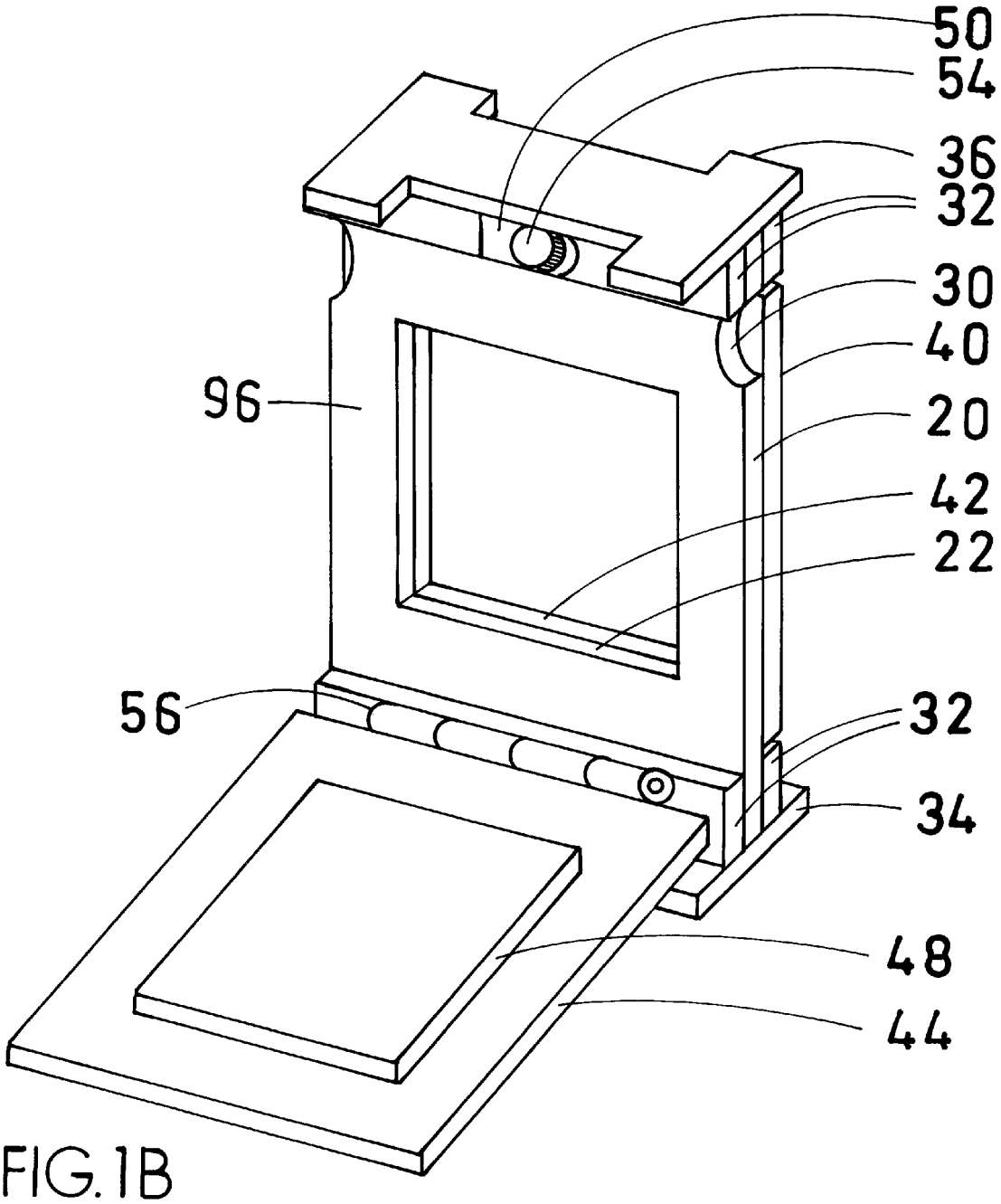
FIG. 1B shows Double Side One Gel Dryer with top frame closed, stage frame open.

Two latches 50 are assembled on one flat surface, at the top end 26 of the main frame (FIG. 7A) for exerting grip on the tope frame 40 (FIG. 7A). One latch is assembled at the top end, on the other flat surface of the main frame (FIG. 1B) for exerting a grip on the stage frame 44 (FIG. 1B). To assemble a latch, an nylon thumb screw 54 (FIG. 4A) is first inserted into the hole 52 (FIG. 4B) of the latch, and then tightened in a hole containing screw thread 58 (FIG. 7). This step is repeated with the other latches and thumb screws.

One hinge 56 is used to attach the top frame 40 to the top surface 86 of an anchor plate located at the bottom end, on one flat surface of the main frame (FIG. 7A). Another hinge is used to attach the stage frame to another flat surface 100 of an anchor plate located at the bottom end, on the other flat surface 96 of the main frame (FIG. 1B). In each case, a part of hinge is attached to the top flat surface of the top anchor plate 86 and the other part of the hinge is attached to the flat surface of either top frame or stage frame that is placed between two anchor plates (FIG. 7A, 1B). When attached, these frames freely open and close in the space present between the anchor plates attached to the main frame (FIGS. 1A, 1B). A completely assembled gel drying apparatus standing erect on a wall plate with frames closed and latches engaged is shown in FIG. 7A. Same apparatus standing erect on a lateral side is shown in FIG. 7B.

OPERATION

The following procedure describes operation of the first preferred (FIG. 1) RoomAir Gel Dryer.

A. Close opening 22 of main frame 20 with stage frame 44 containing attached plate 48, and secure by engaging its latch and thumb screw (FIGS. 1, 1A).

Figure 7C:
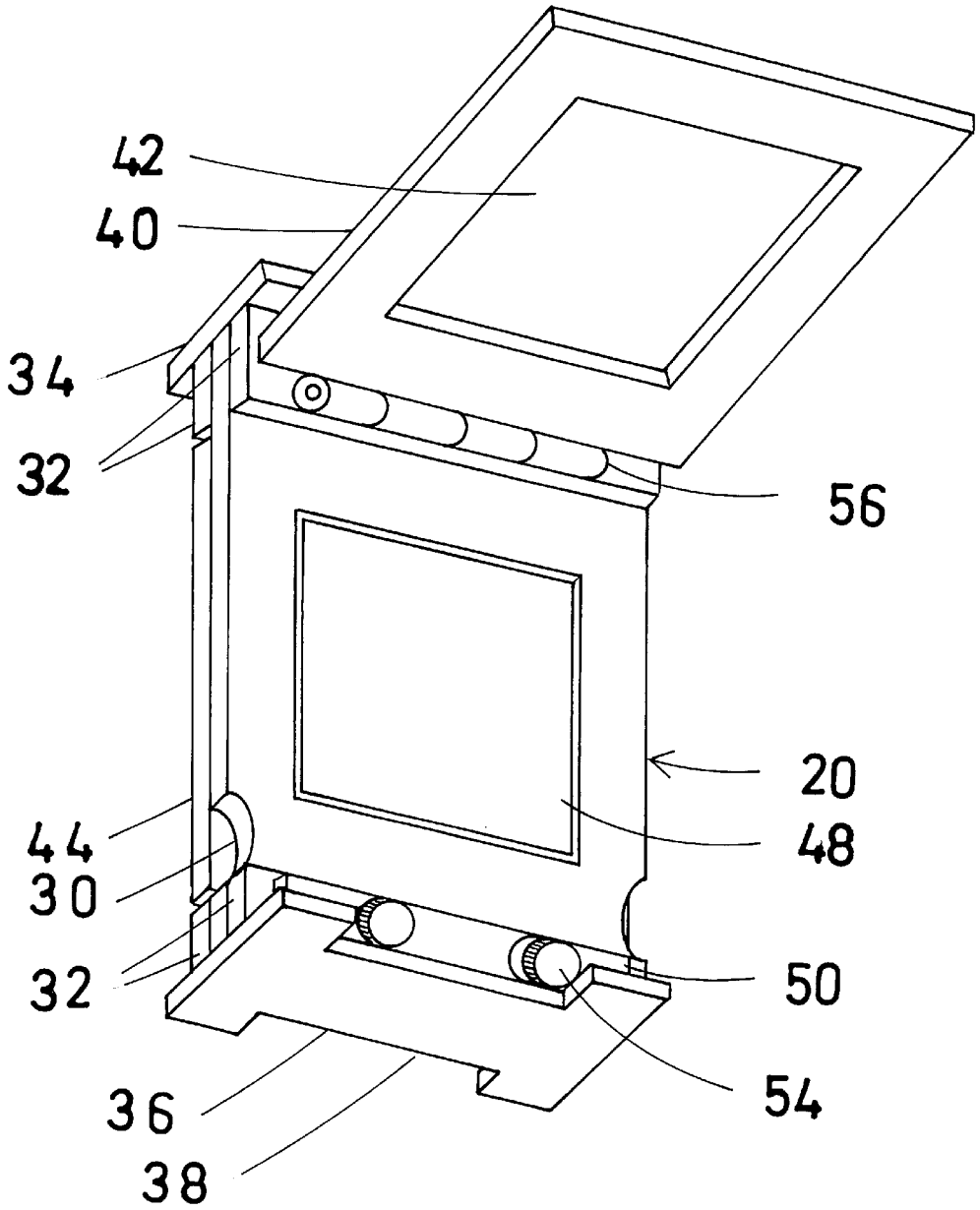
FIG. 7C shows Double Side One Gel Dryer in horizontal position for loading slag gel.

B. Place gel dryer horizontal on a flat surface 82 (FIG. 7A) and lift top frame 40 till it comes to rest at the back end of the apparatus (FIG. 7C).

C. Place a wet cellophane sheet 78 (FIG. 7B1) on main frame so that it covers stage plate and main frame present between anchor plates on one surface of the main frame 94 (FIG. 1A).

D. Place acrylamide gel 80 (FIG. 7B1) on cellophane sheet so that it stays within the boundaries of stage plate 48 (FIG. 7C). Gently squeeze out any air bubbles trapped between the gel and cellophane surfaces.

E. Cover top of gel with another wet cellophane sheet 78 (FIG. 7B1), and press gently to establish contact between surfaces. Eliminate any air bubbles trapped.

F. Lower top frame 40 and secure it with latches 50 ad thumb screws 54 (FIGS. 7C, 7B).

G. Next, disengage stage frame 44 to expose the other side of gel (FIG. 1B).

H. To dry gel from both surfaces, make the apparatus stand erect on its wall plate (FIG. 7A). It can also stand erect on either of its lateral sides (FIG. 7B).

I. When gel is dry, usually after 10 to 16 hours, place the apparatus in a horizontal position. To release hold of latches, make a half turn of thumb screws and push latches towards the wall plate.

J. Place tip of index fingers in the concave grooves 30 of main frame and thumbs on the top anchor plate 32 (FIG. 7C). Lift the top frame all the way till it comes to rest.

K. Similarly, hold margins of gel-cellophane sandwich projecting into the concave grooves 30 and lift to remove from the apparatus, and L. Rinse gel dryer with distilled water and air dry for next use.

DESCRIPTION OF OTHER PREFERRED EMBODIMENTS

Figure 8:
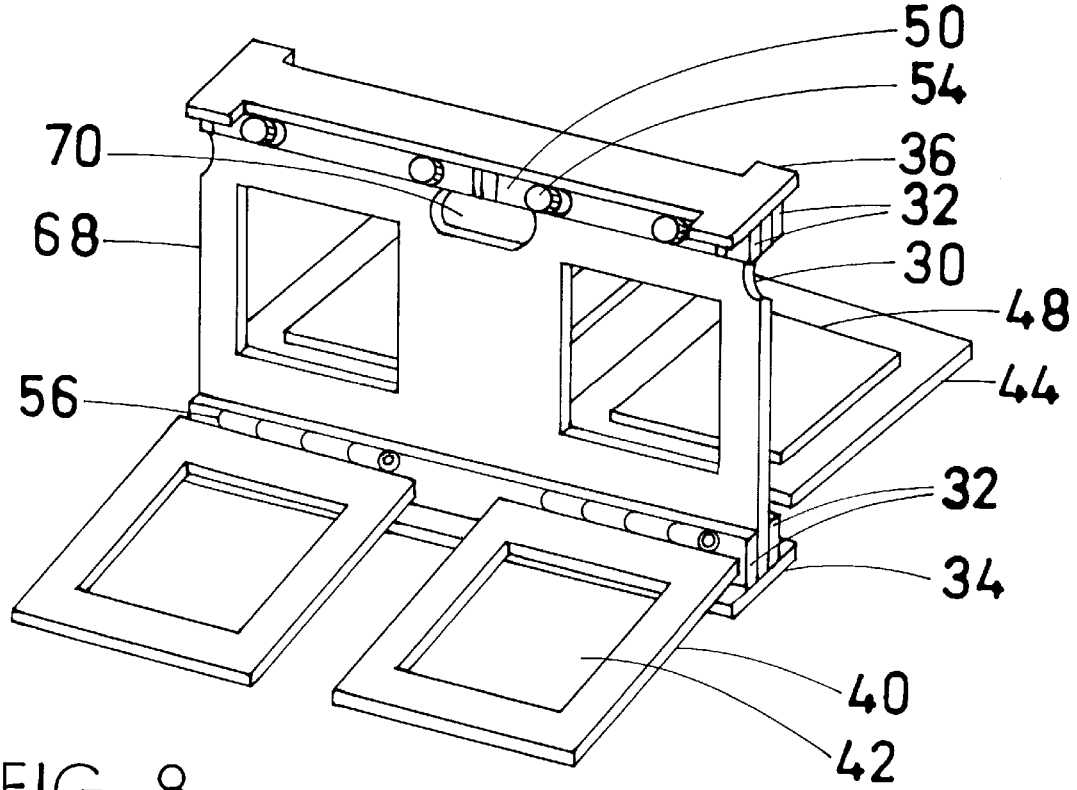
FIG. 8 shows Side by Side, Double Side, Two Gel Dryer with top and stage frames open.

The second preferred embodiment is shown in FIG. 8. It is a Side by Side, Double Side Two Gel Dryer. Structurally, this apparatus has a wide main frame 68 with two square openings. Anchor plates and wall plates are proportionally long. An oblong hole 70, ranging in length between 1" to 2" and width between 0.5" to 1", is made in the middle of main frame. In this embodiment two separate gels can be placed adjacent to one another at the same time or at different times. Removing one gel will not affect the adjacent gel. Operation of this apparatus is similar to that described for the first preferred embodiment.

Figure 9:
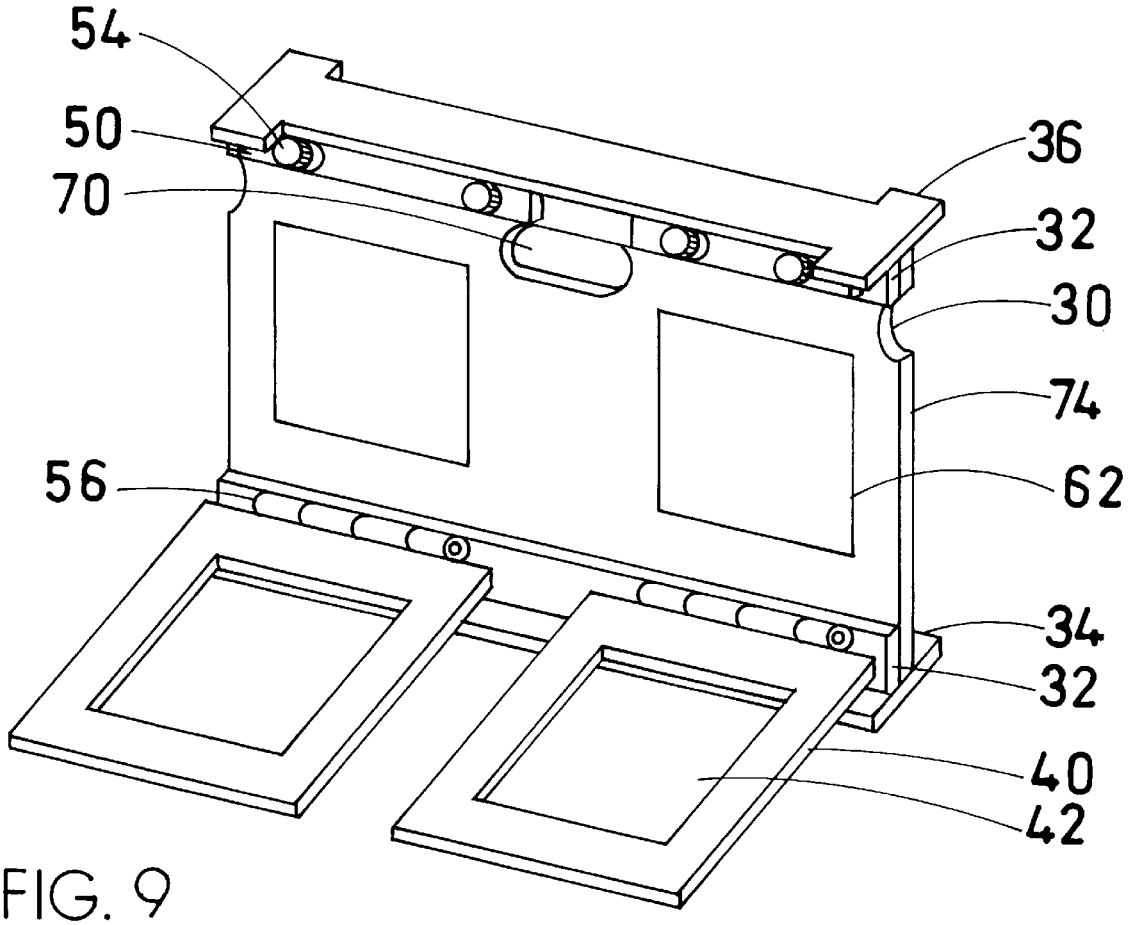
FIG. 9 shows Side by Side, Single Side, Two Gel Dryer with top frames open.

The third preferred embodiment, Side by Side, Single Side Two Gel Dryer, is shown in FIG. 9. This apparatus has a wide main plate 74 to accommodate two gels adjacent to one another. Anchor and wall plates are proportionally long. An oblong hole 70, ranging in length between 1" to 2" and width between 0.5" to 1", is made in the middle of main frame. This apparatus has no square openings in the main plate, no stage frames and no stage plates. Main plate has two etched squares 62 to indicate location for placing gels. Gels can be loaded at the same time or at different times. Loading or unloading of one gel will not affect its adjacent gel.

Figure 10:
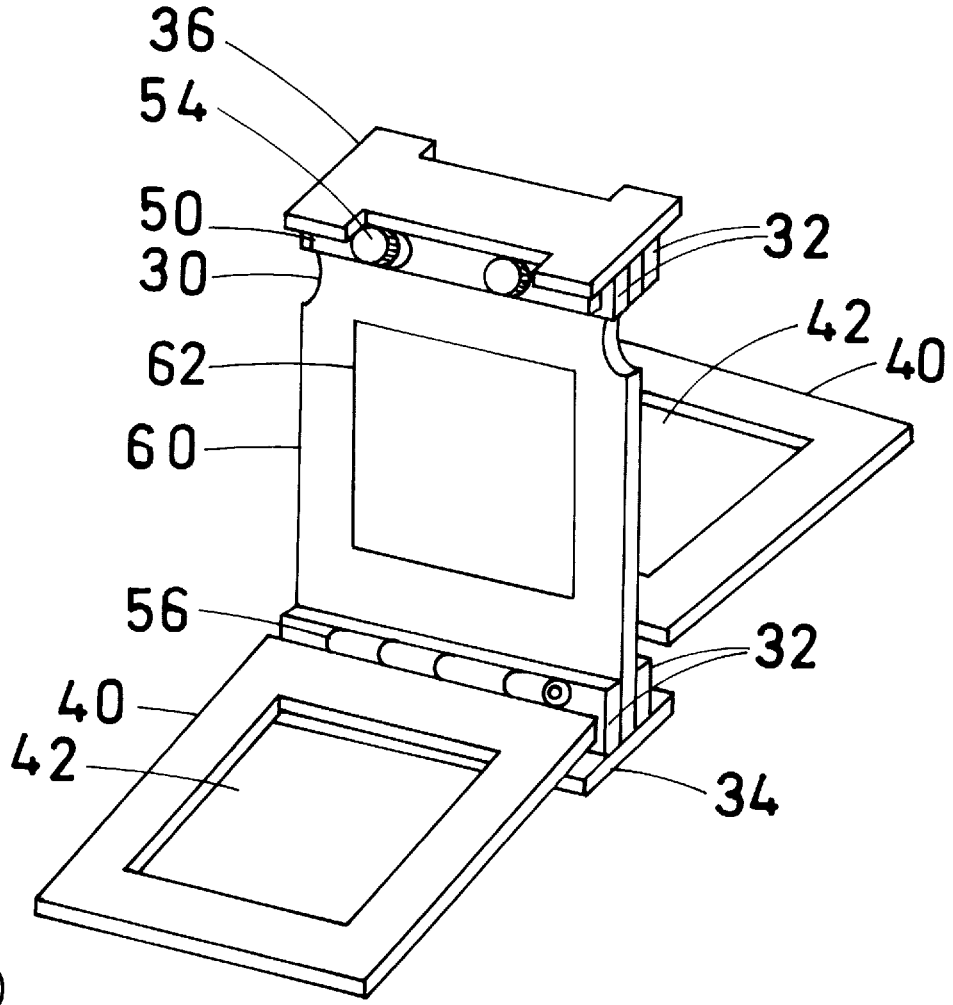
FIG. 10 shows Back to Back Single Side Two Gel Dryer.

The fourth preferred embodiment, Back to Back Single Side Two Gel Dryer, is shown in FIG. 10. This embodiment has a main plate 60 that has no square opening. Also, it has no stage frame or stage plate. However, it has two top frames attached, one to an anchor plate present on one surface of the main plate and the other top frame attached to another anchor plate present on the other flat surface of the main plate. Each gel is exposed to dry from one side only. The location for placing gels is indicated b squares etched 62 on one of the two flat surfaces of the main frame. The main advantage with this apparatus is that it is small and saves space.

Figure 11:
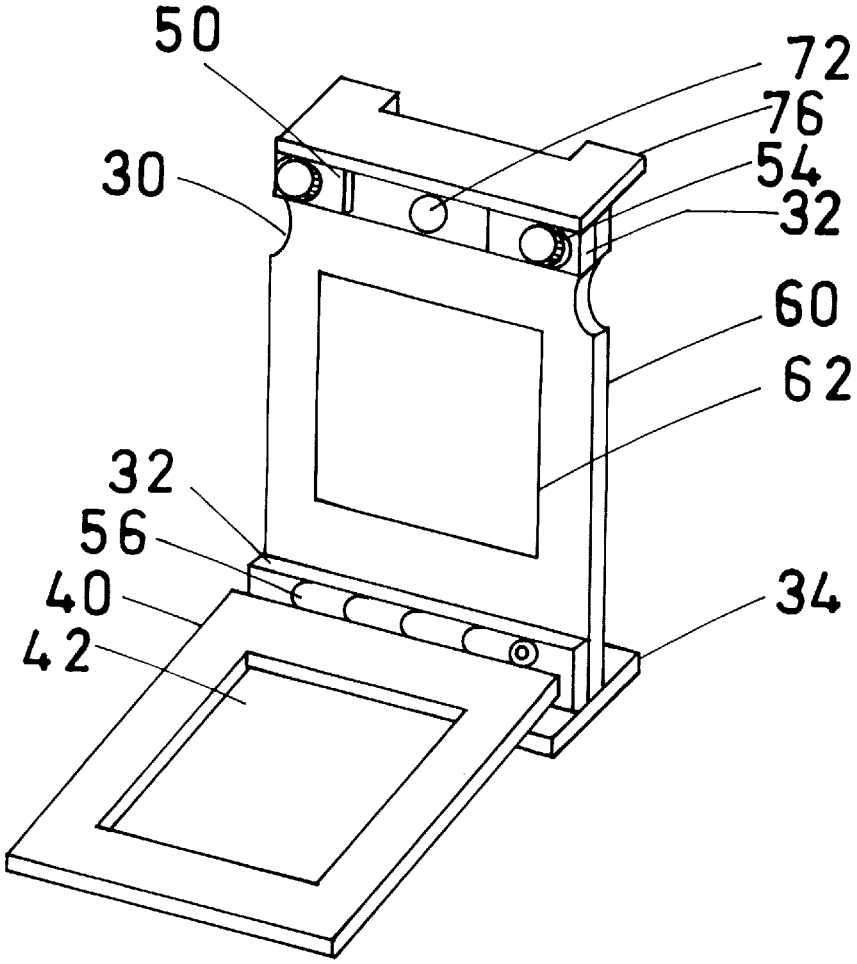
FIG. 11 shows Picture Frame Single Side One Gel Dryer.

The fifth preferred embodiment, Picture Frame Single Side One Gel Dryer, is shown in FIG. 11. This apparatus has a main plate 60 and a top frame 40, but has no stage frame or stage plate. The width of wall plate present at the top end of the main plate is trimmed to the surface level of the top anchor plate 32. The apparatus has a hole 72 for accepting a nail projecting out of a wall for hanging the gel dryer. Main plate has an etched square 62. The main advantage is that it can be hanged from a wall. It can also be made to stand on a flat work bench.

Figure 12:
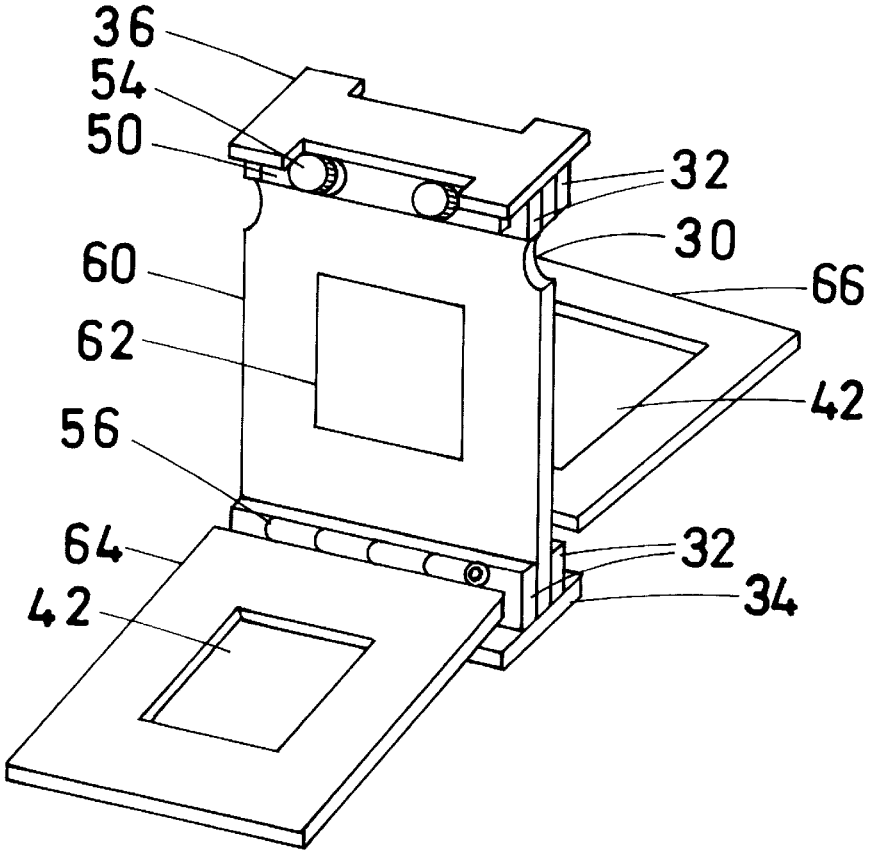
FIG. 12 shows Mini Maxi, Back to Back, Single Side Two Gel Dryer.

The sixth preferred embodiment, Back to Back Mini Maxi Single Side Two Gel Dryer, is shown in FIG. 12. It has a main plate 60 with etched outlines on one of its two flat surfaces for placing gels. It has no stage frame or stage plate. However, it has one top frame to hold a mini gel 64 and another top frame to hold a large gel 66. Both frames are attached to the main plate. Each gel dries from one side only. The main advantage is that same apparatus can be used to dry both a small gel and a large get either at the same time or different times.

Some possible additional variations are described below. Stage frame 44 containing an opening 46 (FIG. 3B) can be replaced by a plate that has no opening. Sizes of various frames and plates can be increased or decreased to accommodate gels of different sizes. The size and shape of latches can be changed to meet different needs. The size and number of hinges can be altered. Wall plates can be derived by bending the top and bottom ends of main plate. Grooves present in the lateral sides of the main frame can be eliminated by making other frames wider on all sides or in certain places, so that when closed, edges project out for lifting the frames.

SUMMARY, RAMIFICATIONS AND SCOPE

From the above described information, the reader can see that acrylamide gels can be dehydrated in a reliable way b using a variety of RoomAir Gel Dryers. They are simple to use and quick to set up. Gels can be assembled directly in the apparatus. The assembled gel can be dried either in horizontal or in vertical positions. Hinges provide localization with permanent orientation as well as alignment, and also easy movement of various frames. Latches press frames which inturn retain gel securely in place. A mere half turn of thumb screw makes latch exert enough pressure on frames which inturn hold gel-cellophane sandwich with a tight grip. There are no separate parts to assemble or disassemble. No parts rust with time. Wall plates serve two purposes; the first purpose is to hold main frame horizontal for assembling gel sandwich, and the second is to hold apparatus vertical for drying gel. In all positions, protein bands in gel can be seen clearly. Because wall plates are wide, the apparatus stays vertical with extra stability. The edges of anchor plates present on one of the two flat surfaces of the main frame help in guiding cellophane sheets to their location. These gel dryers occupy very little room; therefore, they can be placed on a shelf, on a windowsill or in a fume hood. Shallow grooves of main frame eliminate the use of a tool for separation of frames and plates without disfiguring surfaces.

While the basic details of different types of RoomAir Gel Dryers are shown in various embodiments described above, it is understood that additional changes in size, shape, structure, materials and composition can be made without greatly departing from the original conception. Different features can be mixed and matched to produce new combinations. Therefore, the scope of the invention should be determined not by the embodiments illustrated but by the appended claims and their legal equivalents.

What is claimed is:

1. A scientific apparatus for drying electrophoresis gels comprising:

a polygonal main frame with two opposing shallow concave grooves;

a plurality of rectangular anchor plates;

a plurality of polygonal wall plates;

at least one polygonal top frame;

at least one rectangular latch; and at least one thumb screw, so that an acrylamide slab gel can be securely placed, dried and removed from the scientific apparatus.

2. The scientific apparatus of claim 1 wherein said main frame has a flat top and bottom surfaces, two lateral sides, a top and bottom ends and a quadrilateral opening.

3. The scientific apparatus of claim 2, wherein said each lateral side has at least one said concave groove near said top end of said main frame.

4. The scientific apparatus of claim 1, wherein said each anchor plate has a flat top and bottom surfaces, two lateral sides, and a top and bottom ends.

5. The scientific apparatus of claim 4, wherein the length of said each lateral side of said anchor plate is equal to the width of said end of said main frame.

6. The scientific apparatus of claim 4, wherein said each anchor plate is attached by said top flat surface to a predetermined location at said top end, at said bottom end of said top and bottom surfaces of said main frame.

7. The scientific apparatus of claim 1, wherein said each wall plate has two flat surfaces, two lateral sides, and a top and bottom ends, both with similar widths.

8. The scientific apparatus of claim 7, wherein said each wall plate has a length that is equal to the width of said end of said main frame.

9. The scientific apparatus of claim 7, wherein said each wall plate is attached by a predetermined region on any one of said two flat surfaces, to a predetermined end of said main frame so as to make said flat surfaces of said wall plate and said main frame remain perpendicular to one another.

10. The scientific apparatus of claim 9, wherein the width of said wall plate is distributed equally on both sides of said top and bottom surfaces of said main frame.

11. The scientific apparatus of claim 1, wherein said top frame fits in the space present between said anchor plates attached to said top end and said bottom end of said top flat surface of said main frame.

12. A scientific apparatus for drying electrophoresis gels comprising:

a polygonal main frame with two opposing shallow concave grooves;

a plurality of rectangular anchor plates;

a plurality of polygonal wall plates;

at least one polygonal top frame;

at least one rectangular latch, said latch having two flat surfaces, two lateral sides, two ends, and a hole at one of said two ends; and at least one thumb screw, so that an acrylamide slab gel can be securely placed, dried and removed from the scientific apparatus.

13. The scientific apparatus of claim 12, wherein said thumb screw after assembly with said latch exerts pressure on said top frame.

* * * * *